US005575024A

United States Patent [19]

You

[11] Patent Number: 5,575,024

[45] Date of Patent: Nov. 19, 1996

[54] EARTHQUAKE PROTECTIVE BED

[76] Inventor: Do Nam You, 3270 W. 8th St., Los Angeles, Calif. 90005

[21] Appl. No.: 441,556

[22] Filed: May 15, 1995

[51] Int. Cl.[6] ..... A47C 19/22

[52] U.S. Cl. ..... 5/424; 5/414; 5/308; 52/167.1

[58] Field of Search ..... 5/131, 424, 414, 5/1, 3, 308, 415; 52/167.1

[56] References Cited

U.S. PATENT DOCUMENTS

| | | | |
|---|---|---|---|
| 4,069,527 | 1/1978 | Harris | 5/414 |
| 4,490,864 | 1/1985 | Wicker, Jr. | 52/167.1 X |
| 4,782,541 | 11/1988 | Tuchman . | |
| 4,965,895 | 10/1990 | Shustov . | |
| 5,111,543 | 5/1992 | Epshetsky et al. . | |
| 5,345,126 | 10/1994 | Pedrego | 52/167.1 X |

FOREIGN PATENT DOCUMENTS

| | | | |
|---|---|---|---|
| 2255938 | 11/1992 | United Kingdom | 52/167 R |

*Primary Examiner*—Michael F. Trettel
*Attorney, Agent, or Firm*—Eugene Oak, Ph.D., J.D.

[57] ABSTRACT

The present invention is a bed comprising a mattress which, in the event of an earthquake, is mechanically lowered into its rectangular frame. The movement caused by the earthquake further causes an attached, large, rectangular cover to mechanically collapse onto the top of the rectangular frame, thereby protecting the occupant or occupants of the bed. The bed and cover contain additional springs and supports, respectively, which enable the present invention to withhold the weight of accumulated and falling debris. Once an occupant is safely within the collapsed bed, means are provided within the bed to sustain the life of the occupant until outside assistance is received. When the cover of the bed is in its uncollapsed position, it unobtrusively lies against a wall of a bedroom acting as a vertical extension of the headboard and further containing useable and decorative shelves and/or cabinets.

9 Claims, 11 Drawing Sheets

39
38
14
36
12
37

14
39
38
36
37
20
12

12
10
7

EARTHQUAKE PROTECTIVE BED

FIELD OF THE INVENTION

The present invention generally relates to a bed, particularly to a bed which is designed to protect an occupant or occupants in the event of an earthquake.

BACKGROUND OF THE INVENTION

Earthquakes are a very real and unpredictable threat to people today. These catastrophes are particularly dangerous to people who are within standing structures, such as buildings and houses, as falling debris to some extent is an inevitable occurrence. However, such falling debris is most dangerous during the night, when most people are asleep in their beds.

Conventional beds are typically composed of a mattress seated on top of a spring-loaded wooden frame, commonly referred to as a "box spring", which is further mounted on top of a metal frame. In addition to various mattress sizes, varied arrangements are available for such beds. A standard one-level bed provides no protection from falling debris. Although bunk beds provide some protection to occupants of the lower bunk during an earthquake, the occupant of the upper bunk is still vulnerable to falling debris. In addition, bunk beds are primarily used in places where space is limited, such as college dormitories and children's bedrooms, thus excluding a large percentage of the population.

The following prior art disclose various means of protecting occupants of a bed during an earthquake.

U.S. Pat. No. 5,111,543 to Epshetsky et al. discloses a foldable earthquake protective bed comprising a support frame and two moveable members pivotally attached to the support frame and capable of being pivoted between a folded position in which the moveable members are arranged as conventional parts of the bed and an unfolded position in which they form a rigid protective cover above the bed's occupant(s).

U.S. Pat. No. 4,782,541 to Tuchman discloses a protective bed suitable for protecting an occupant or occupants during major catastrophes resulting in falling debris including a canopy made of steel mesh which is resistant to penetration by an accumulation of falling debris.

U.S. Pat. No. 4,965,895 to Shustov discloses a manufacture for sheltering people in a case of earthquake emergency using an existing bed. The shelter has a horizontal frame of shelves for placing the bed on, confiners for fixing the bed, a cover on supports, and a base isolating system of ball-bearing footholds on pedestal plates with concave upper surfaces of proper curvature.

Although these prior art disclose various means of protecting occupants of a bed during an earthquake, none of them disclose an earthquake protective bed of the particular structure and novelty as disclosed and claimed hereafter.

It is thus a primary objective of the present invention to provide a bed which effectively protects an occupant or occupants from accumulated falling debris in the event of an earthquake.

It is another objective of the present invention to provide a bed which in its collapsed position can sustain the life of an occupant or occupants within the bed while it is buried under fallen debris.

It is still another objective of the present invention to provide a bed which in its uncollapsed position does not occupy an excessive amount of vertical space.

It is yet another objective of the present invention to provide a bed which includes a useful as well as decorative earthquake protective cover.

SUMMARY OF THE INVENTION

The present invention is a bed comprising a mattress which, in the event of an earthquake, is mechanically lowered into its rectangular frame. The movement caused by the earthquake further causes an attached, large, rectangular cover to mechanically collapse onto the top of the rectangular frame, thereby protecting the occupant or occupants of the bed from falling debris. The legs of the bed contain impacting-absorbing springs and the cover is reinforced with supports, both of which aid the present invention in withholding the weight of accumulated and falling debris. Once an occupant is safely within the collapsed bed, means are provided within the bed to sustain the life of the occupant until outside assistance is received. When the cover of the bed is in its uncollapsed position, it unobtrusively lies against a wall of a bedroom, acting as a vertical extension of the headboard and further containing useable and decorative shelves and/or cabinets.

Furthermore, the present invention may be separated into several smaller pieces to facilitate convenient moving.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated a preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE DRAWINGS

Figure 1:
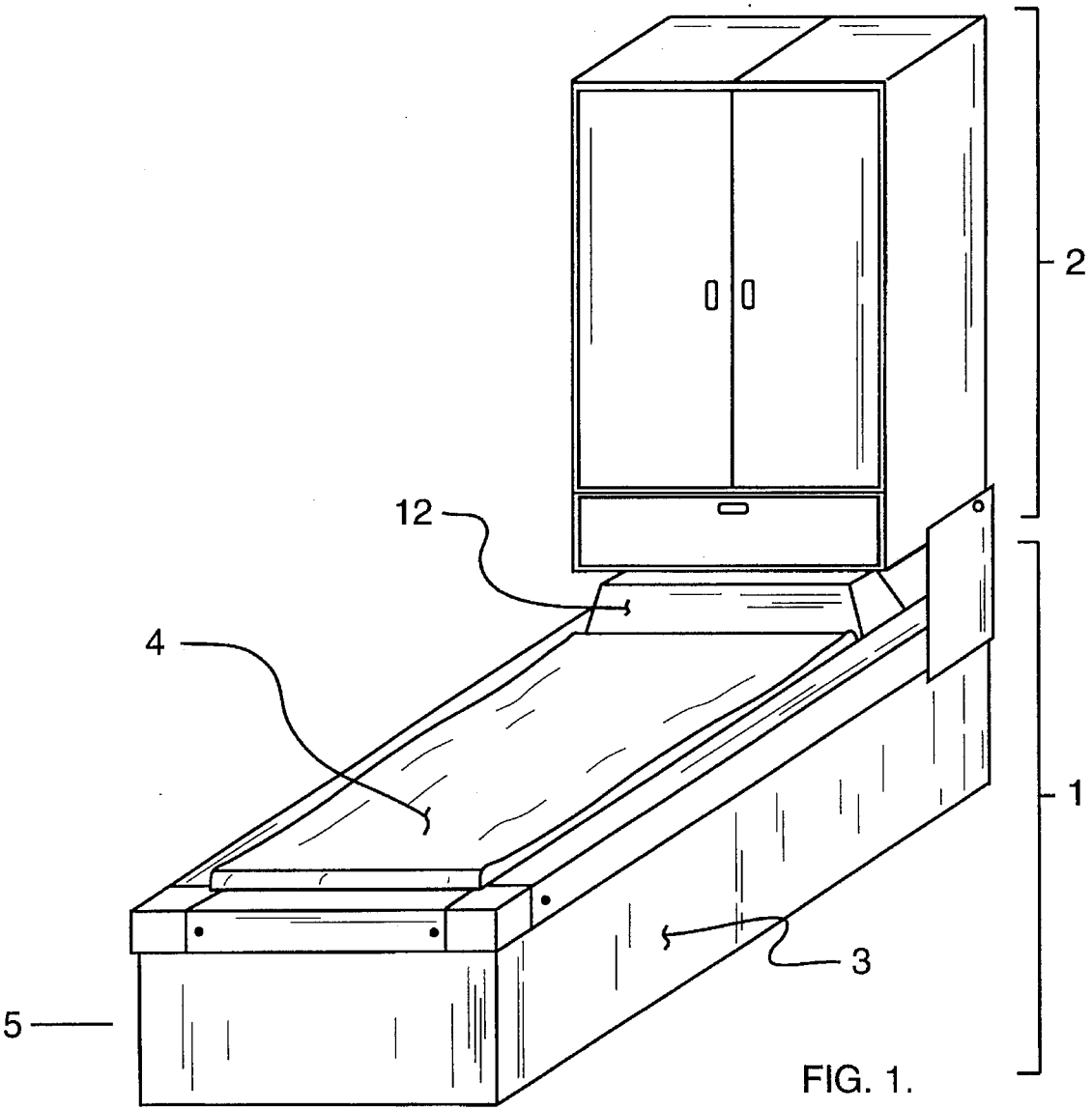
FIG. 1 is a perspective view of the present invention.

Referring now to FIG. 1, a perspective view of the present invention is shown. The invention generally comprises two portions. The lower portion 1 comprises a bed frame 5 with a mattress 4 mounted onto a mattress support 12 which may be lowered into the bed frame 5. A cloth-type material 3 is draped from the upper edge of all sides of the bed frame 5. The upper portion 2 of the present invention is a cover which may be pivoted between a vertical and horizontal position and may also be used as an area for storage.

Figures 2, 2A, 2B:
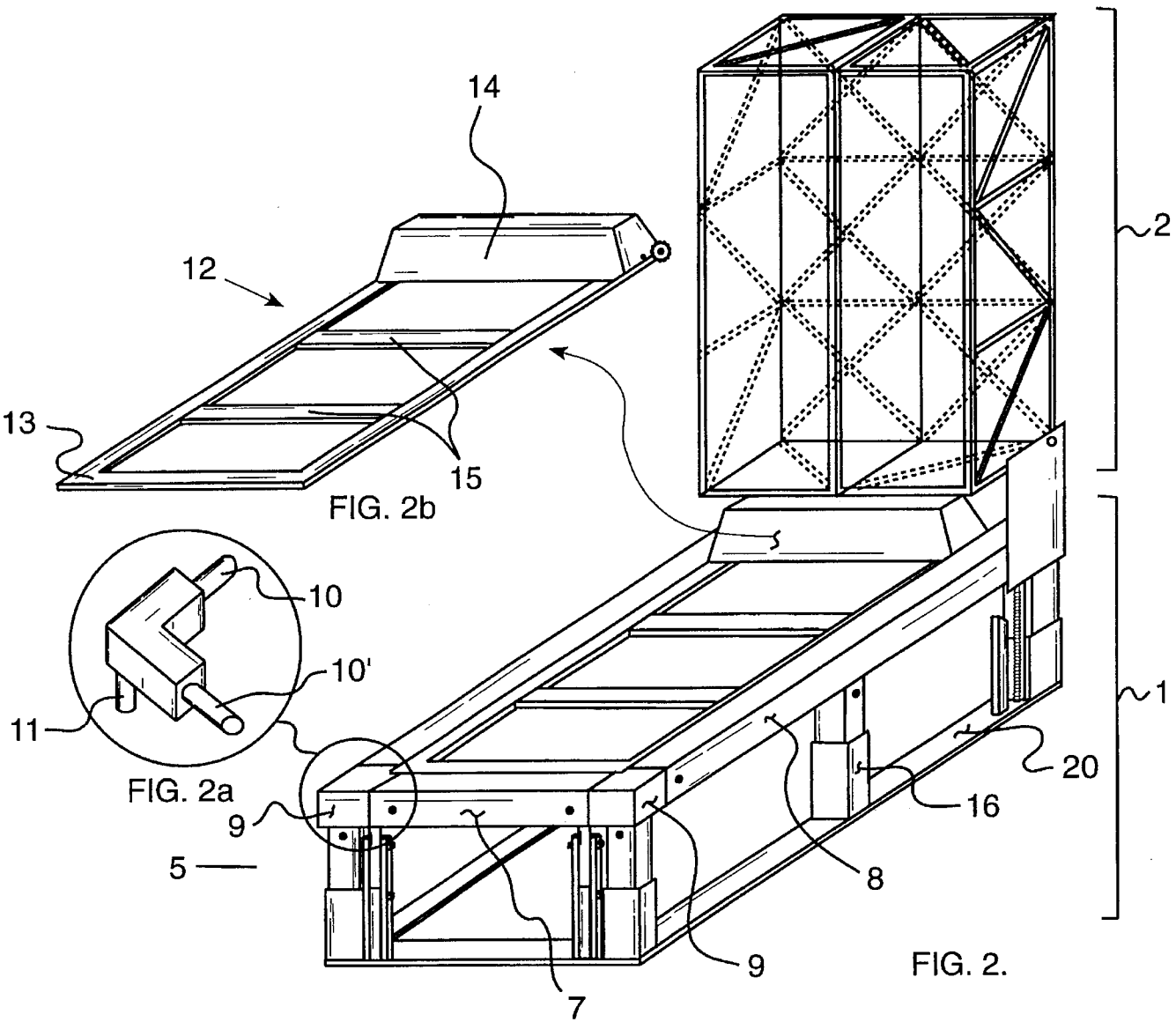
FIG. 2 is a view of the present invention showing the skeleton structure of both the bed and cover portions.

Referring now to FIG. 2, the skeletal structure of the present invention is shown. The top of the bed frame 5 is a rectangular frame comprising two parallel long beams 8 perpendicularly connected to two parallel short beams 7 by means of four corner pieces 9, more clearly shown in FIG. 2*a*. Each of these corner pieces 9 contains two horizontal prongs 10 and 10' and one vertical prong 11. The horizontal prongs 10 and 10' are perpendicular to each other and are designed to join one end of a long beam 8 to one end of a short beam 7, ultimately forming a rectangular frame comprising two long beams 8, two short beams 7, and four corner pieces 9.

The mattress support 12, fully exposed in FIG. 2*b*, is comprised of a rectangular outer frame 13 with a raised, trapezoidal headpiece 14 at one end and two cross support beams 15 connecting the long sides of the rectangular outer frame 13.

Figure 3:
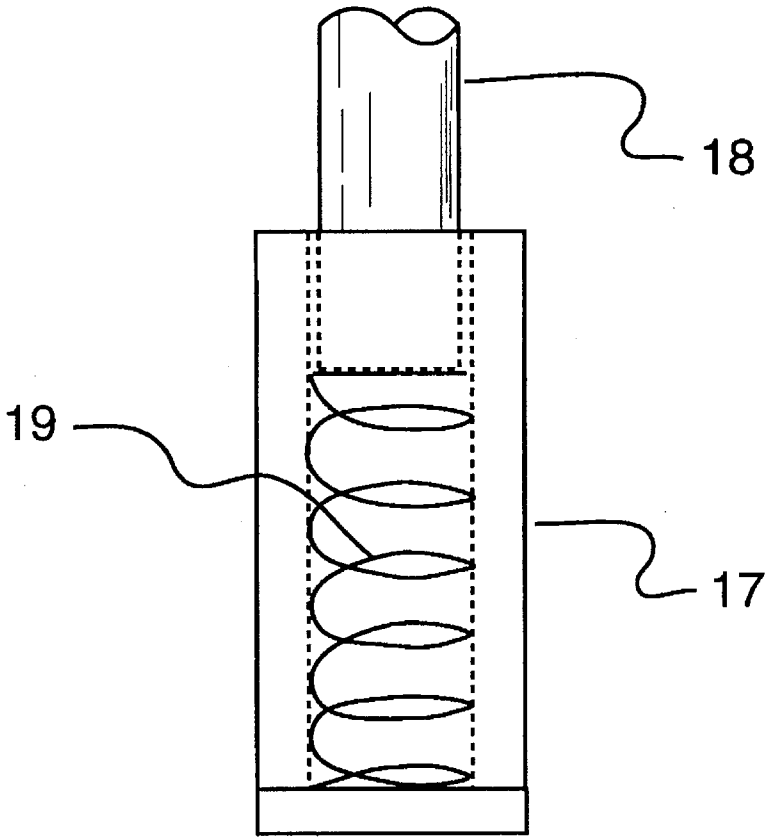
FIG. 3 is an exploded view of a leg of the present invention.

The bottom of the bed frame 5 comprises a flat, molded rectangular frame 20 with the same length and width dimensions as the top of the bed frame 5. Six spring-loaded legs 16 extend upward from the molded, rectangular frame 20 and support the upper rectangular frame. Four spring-loaded legs 16 extend upward from each of the corners of the molded, rectangular frame 20 and are each attached to a corresponding corner piece 9 by means of the vertical prong 11 which protrudes downward from each of the corner pieces 9. The remaining two of the six spring-loaded legs 16 extend upward from the middle of each of the long sides of the molded rectangular frame 20. These legs 16 are similarly joined to the middle of the lower side of each of the long beams 8. An exploded view of a spring-loaded leg 16 is shown in FIG. 3. The spring-loaded leg 16 is comprised of a lower female portion 17 housing a spring 19 which may be accessed through an opening in the top of the female portion 17. An upper male portion 18 is partially inserted into the opening of the female portion 17 and rests on the partially compressed spring 19.

The skeletal structure of the cover, generally referred to as 2 in FIG. 1, is also shown in FIG. 2. The length and width of the cover 2 are the same as the dimensions of the top of the bed frame 5. The skeletal structure of the cover 2 is shown in more detail in FIG. 4.

Figure 4:
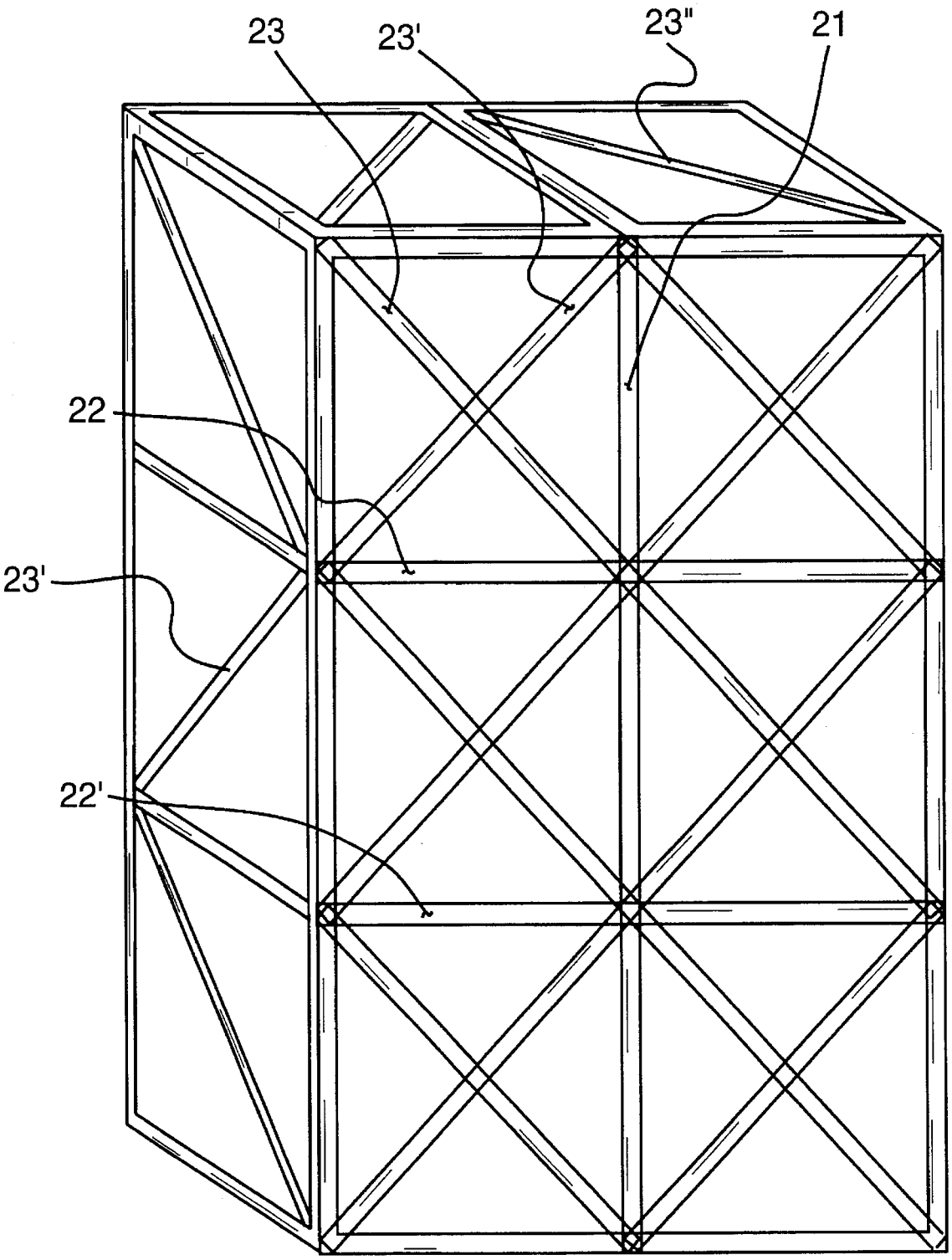
FIG. 4 is a skeletal view of the upper cover portion of the present invention.

Referring now to FIG. 4, the skeletal structure of the cover 2 is comprised of narrow, flexible, steel beams. The rectangular rear wall of the cover 2 is divided into six equally sized square spaces by means of one vertical cross beam 21 and two horizontal cross beams 22 and 22'. Each of these six square spaces is further divided by two diagonal cross beams 23 and 23'. The rectangular front wall, not shown, is of the same length and width as the rear wall, but it does not have supporting cross beams. The front wall may be divided into drawers and/or cabinets so that the inside of the cover 2 might be used as storage space. The rear wall and front wall are parallel and are joined by four side walls. Two of the side walls are divided into three square spaces and the other two of the side walls are divided into two square spaces. Each of these ten square spaces is further divided by only one diagonal support beam 23". When the bed is in its collapsed position, the rear wall of the cover 2, supported by the reinforced side walls, effectively becomes the upper shield of the entire bed. The structure of flexible supporting beams described above protects the occupant of the bed from falling debris.

Figure 5:
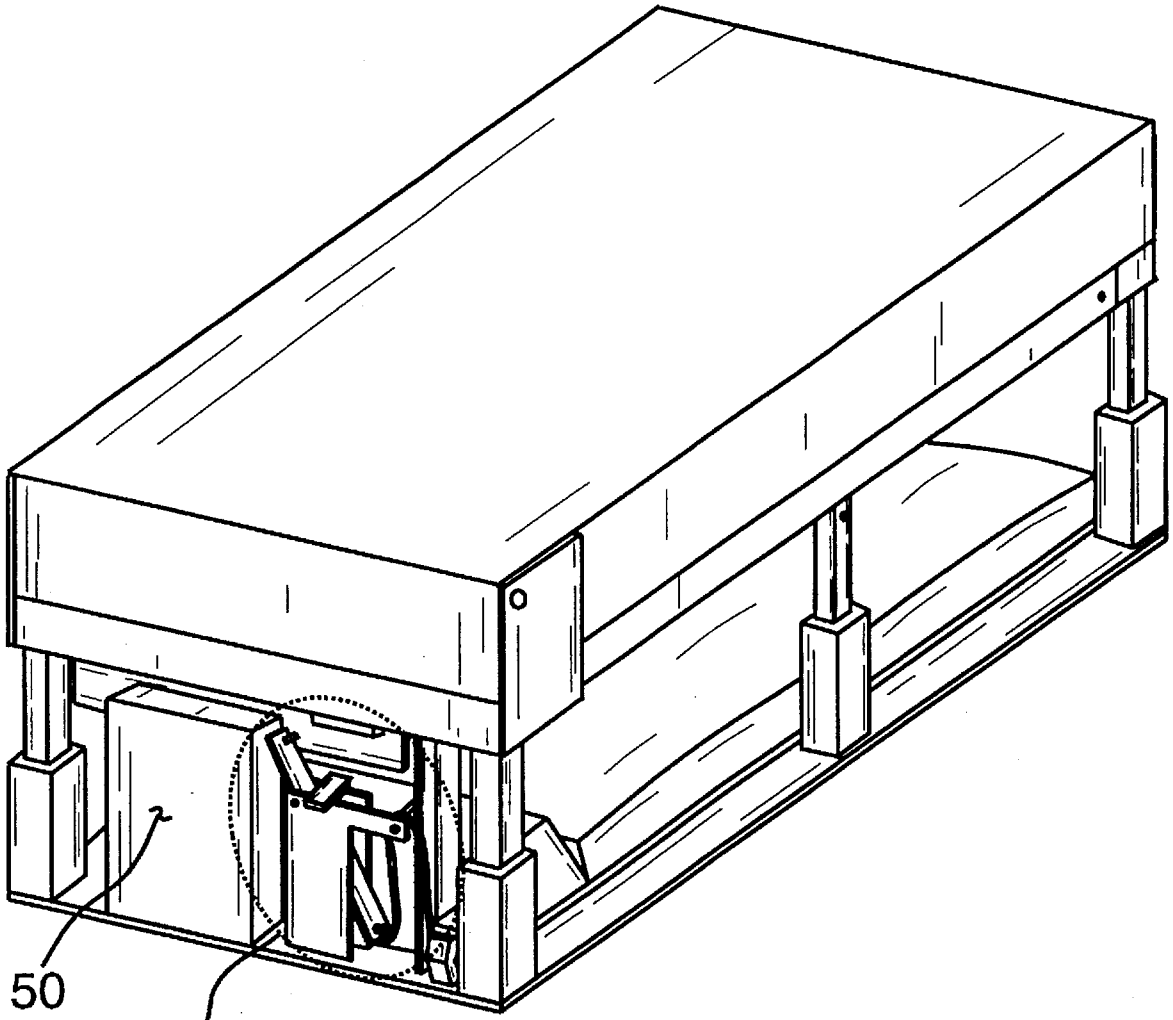
FIG. 5 is a perspective rear view of the present invention.

Referring now to FIG. 5, a rear view of the present invention exposes an alarm box 50 and a triggering system, generally referred to as 24. The invention is shown in its fully collapsed position. The alarm box 50 houses a conventional alarm system with a signalling button accessible from the inside of the bed. After an occupant has been secured within the collapsed bed, the alarm box 50 will be positioned near his or her head. The alarm box 50 may also contain items necessary for survival within the bed, such as non-perishable food, water, and a first aid kit. All of the contents of the alarm box are accessible from the inside of the lower bed portion. An exploded view of the triggering system 24 is shown in FIG. 6.

Figures 6, 6A:
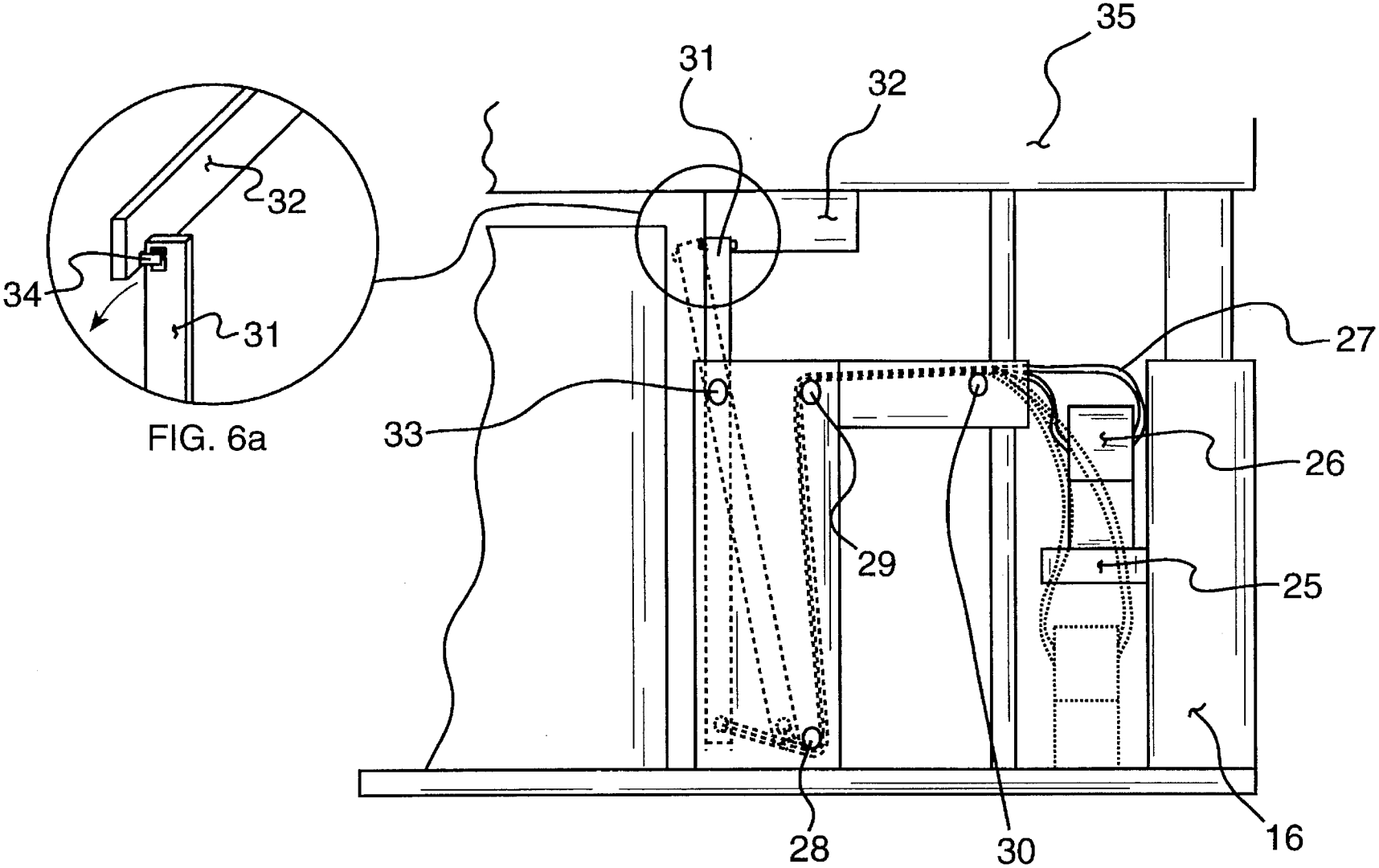
FIG. 6 is an exploded view of the triggering device of the present invention.

Referring now to FIG. 6, the triggering system of the present invention is specifically comprised of a narrow ledge 25, a weight 26, a rope 27, three rope pivots 28, 29, and 30, a vertical lever 31, a trigger piece 32, and a lever pivot 33. The weight 26 rests on the narrow ledge 25 which extends inwardly from the rear, left leg 16 of the bed. The rope 27 is attached at one end to the weight 26 and is looped around the three rope pivots 28, 29, and 30, being attached at its other end to the bottom of the vertical lever 31. The vertical lever 31 is attached near its upper end to the lever pivot 33. The trigger piece 32 rests against and outwardly applies pressure to the top of the vertical lever 31.

In the event of an earthquake, the inherent movement of the earthquake causes the weight 26 to fall off of the narrow ledge 25. As the weight 26 falls to the ground, it pulls the rope 27 down with it. As the rope 27 is pulled around the three rope pivots 28, 29, and 30, its other end simultaneously pulls the bottom of the vertical lever 31, causing the vertical lever 31 to pivot around the lever pivot 33. Thus, as the bottom of the vertical lever 31 is pulled to the right, the top of the vertical lever 31 moves to the left, thereby releasing the trigger piece 32. This action is shown in detail in FIG. 6*a*. A ball bearing 34 protrudes from the side of the top of the vertical lever 31 which contacts the trigger piece 32, thereby reducing the friction between the vertical lever 31 and the trigger piece 32.

Figure 7B:
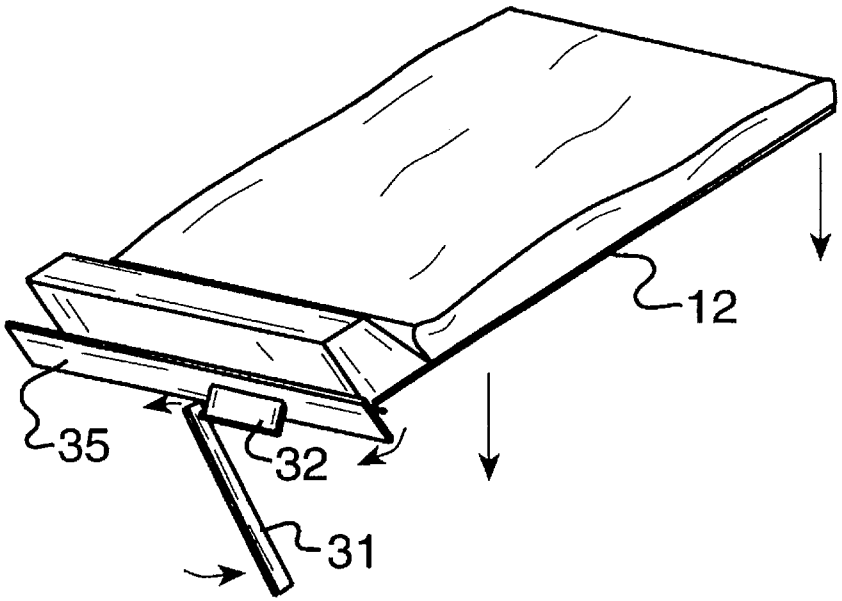
FIG. 7 is a sectional view of the mattress support of the present invention being released by the triggering device.
Figure 7A:
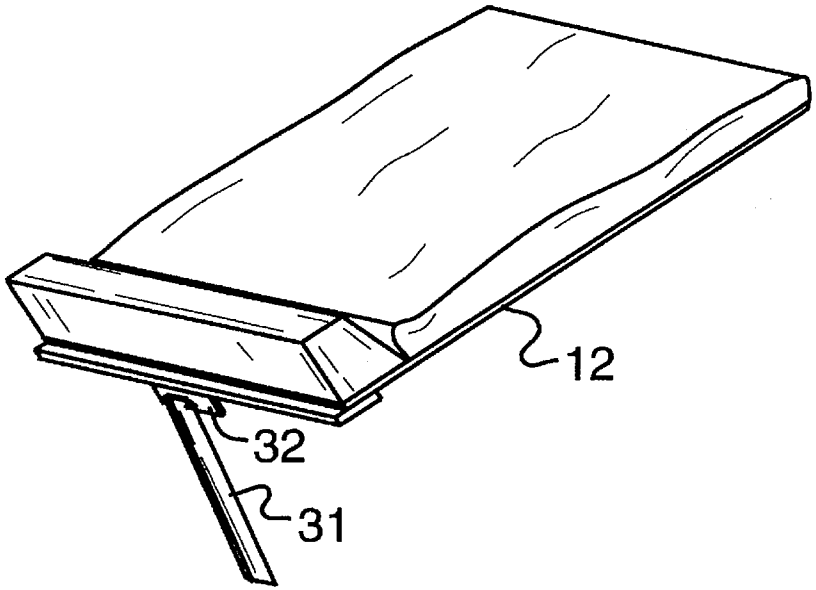

The effect of the triggering system described above is shown in FIG. 7. FIG. 7*a* shows the state of the mattress support 12 before the lever 31 has been moved. FIG. 7*b* shows the state of the mattress support 12 after the lever 31 has been moved.

Referring now to FIG. 7*a*, the trigger piece 32 is shown resting against and outwardly applying pressure to the vertical lever 31. The trigger piece 32 is connected to and extends downward from a larger support beam 35 on which the head-end of the mattress support 12 rests. Thus, when the triggering system shown in FIG. 6 and described above is activated, the vertical lever 31 releases the trigger piece 32, thereby allowing the larger support beam 35 to fall and drop the mattress support 12. The releasing actions described above are illustrated in FIG. 7*b*.

Figures 8A, 8B, 8C:
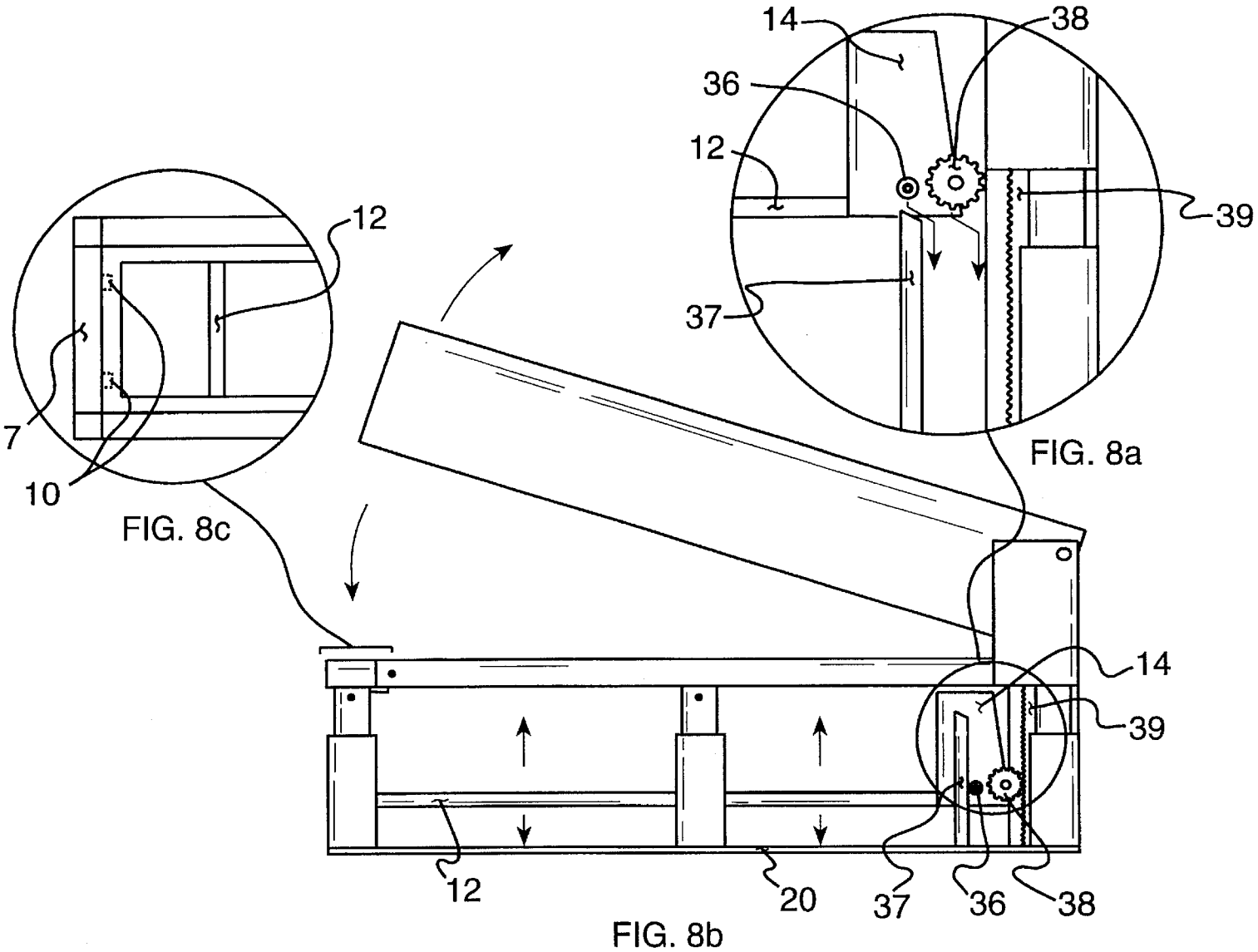
FIG. 8 is a side view of the present invention showing the interior elements.

In FIG. 8, a side view of the present invention demonstrates the movement of the mattress support 12 as it is released in the manner described above. FIG. 8*a* shows an exploded view of the components necessary to lower the mattress support 12 in a slow and steady manner. The mattress support 12 as shown in FIG. 8*a* has not yet been released. A small flywheel 36 and a large gear 38 extend from a side of the trapezoidal headpiece 14 of the mattress support 12. The small flywheel 36 is positioned directly above a vertical post 37 which extends upward from the molded, rectangular frame 20 and has a wedge-shaped top. A vertical gear rail 39, which also extends upward from the molded, rectangular frame 20, is positioned to the right of the large gear 38. As the mattress support 12 is released in the manner shown in FIG. 7, the small flywheel 36 falls and contacts the wedge-shaped top of the vertical post 37. As the wedge-shaped top of the vertical post 37 guides the small flywheel 36 to the right, the large gear 38 is brought into contact with the vertical gear rail 39. As the teeth of the large gear 38 align with the teeth of the vertical gear rail 39, the large gear 38 is able to roll down the vertical gear rail 39 in a slow and steady manner. The small flywheel 36 and the large gear 38 are designed to form a gapless fit between the vertical post 37 and the vertical gear rail 39, respectively. Thus, the large gear 38 is held against the vertical gear rail 39 for the entire duration of its downward travel. The mattress support 12 is shown in downward travel within the context of the entire invention in FIG. 8*b*. All of the above-described components exist in reverse formation on the opposite side of the present invention and are not shown.

Referring to FIG. 8*c*, a top view is shown of the foot-end of the bed. While the wedge-shaped top of the vertical post 37 guides the small flywheel 36 to the right as described above, essentially pulling the mattress support 12 toward the head-end of the bed, another action occurs at the same time that the large gear 38 is brought into contact with the vertical gear rail 39. The foot-end of the mattress support 12 initially rests on two ledges 40 which extend inwardly from the foot-end short beam 7 of the upper portion of the bed frame. As the mattress support 12 is pulled toward the head-end of the bed, the foot-end of the mattress support 12 is correspondingly pulled off of the ledges and falls downward.

Figure 9:
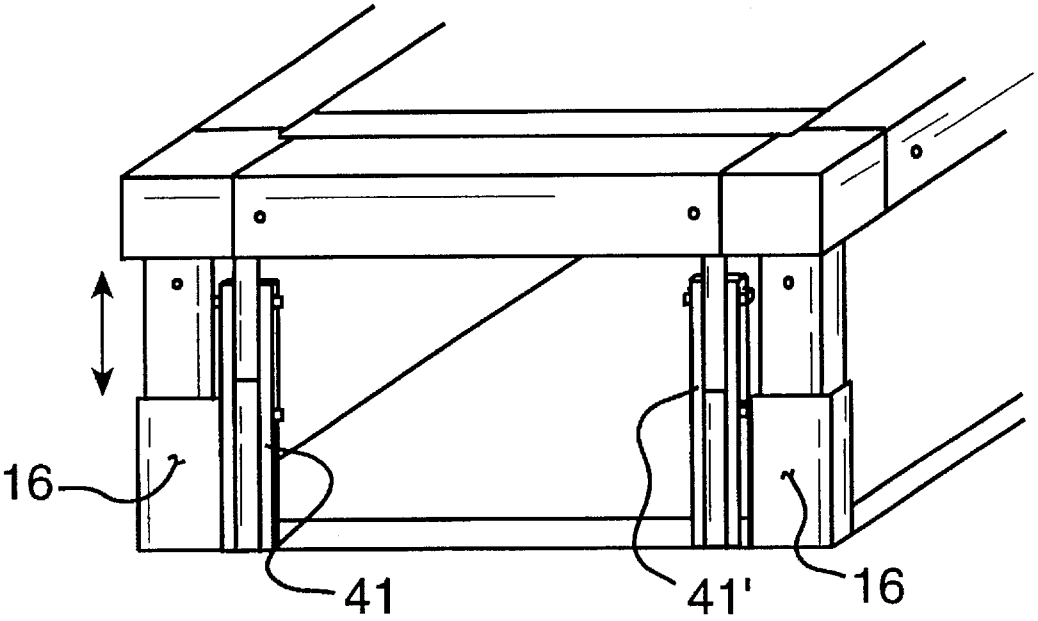
FIG. 9 is a sectional view of the foot-end of the present invention.

Referring now to FIG. 9, a perspective view of the foot-end of the present invention is shown. Each of the legs 16 is loaded with a spring, shown in more detail via FIG. 3. While the legs must be able to be compressed in the event of an earthquake, it is undesirable for these legs 16 to be compressible during normal, everyday use of the bed. Therefore two vertical support devices 41 and 41' have been provided to hold the legs 16 in their fully extended position. These vertical support devices are designed to collapse in the event of an earthquake. The function of these vertical support devices 41 and 41' are more clearly shown in FIG. 10.

Figure 10:
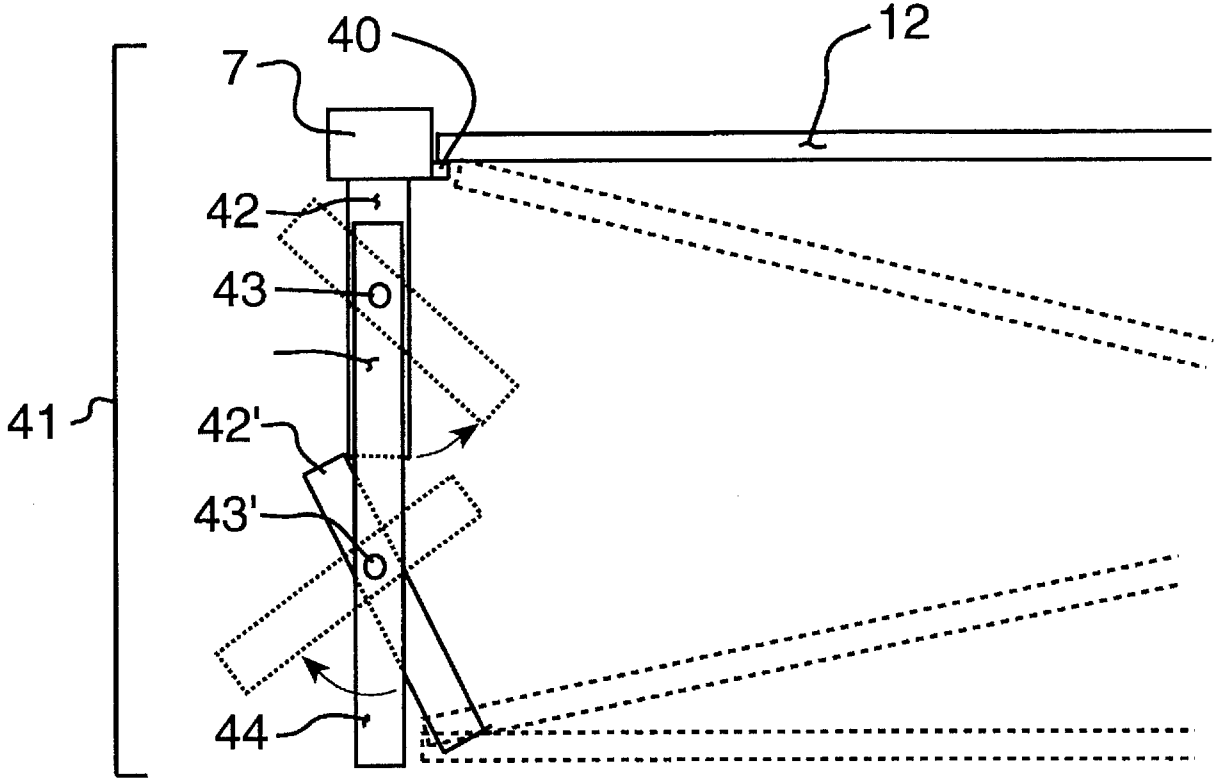
FIG. 10 is a sectional side view of the leg release system of the present invention.

Referring now to FIG. 10, a side view of the foot-end of the present invention demonstrates the movement of one of the vertical support devices 41'. The other vertical support device 41 is unseen because it is positioned directly behind the vertical support device shown 41'. However, the other vertical support device 41 functions in exactly the same manner as the vertical support device shown 41'.

The vertical support device 41' comprises an upper pivot piece 42 and a lower pivot piece 42' connected to a vertical post 44 by means of an upper pivot 43 and lower pivot 43', respectively. The upper pivot piece 42 is initially set parallel to the vertical post 44. The entire upper surface of the upper pivot piece 42 contacts the lower side of the upper foot-end short beam 7. Thus, the vertical post 44 supports the upper pivot piece 42 by means of the upper pivot 43, and the upper pivot piece 42 in turn supports the upper foot-end short beam 7, thereby holding the legs 16 in their fully extended position. The lower pivot piece 42' is initially set at an angle that digresses slightly from the vertical axis of the vertical post 44. This angle causes the upper right corner of the lower pivot piece 42' to rest against the lower left corner of the upper pivot piece 42 and the lower right corner of the lower pivot piece 42' to extend into the present invention so that it is positioned below the foot-end of the mattress support 12.

As stated earlier, the mattress support 12 initially rests upon the ledges 40 which extend from the inner side of the foot-end short beam 7 of the upper portion of the bed frame. As the triggering system shown in FIG. 6 is activated, the head-end of the mattress support 12 is released, falls, and is pulled toward the head-end of the invention as shown in FIGS. 8*a* and 8*b*. During this time, the foot end of the mattress support 12 is pulled off of the ledges 40 and is also allowed to fall. Since the head-end of the mattress support 12 falls before the foot-end, the foot-end of the mattress support 12 initially falls at an angle, approaching the vertical support devices 41 and 41'. The movement of the foot-end of the mattress support 12 is shown in detail in FIG. 10.

Although the movement of only one vertical support device 41' is described below, please note that the other vertical support device 41 is contacted and reacts simultaneously with the first vertical support device 41'. As the mattress support 12 falls, the foot-end of the mattress support 12 strikes the lower right corner of the lower pivot piece 42', flipping it outward. This in turn causes the top of the lower pivot piece 42' to move inward, thereby causing the upper pivot piece 42 to turn counter-clockwise. Consequently, the vertical support created by the vertical post 44 and upper pivot piece 42 is broken and the legs 16 are able to be compressed.

Although the head-end of the mattress support 12 falls first, the small flywheel 36 and large gear 38 cause the head-end of the mattress support 12 to fall more slowly once they are engaged between the vertical post 37 and the vertical gear rail 39, described above and shown via FIGS. 8*a* and 8*b*. The foot-end of the mattress support 12 nevertheless continues to fall without restrain and thus reaches the ground before the head-end of the mattress support 12, as shown in FIG. 10.

Referring again to FIG. 2, the cover 2 initially rests on top of the raised, trapezoidal headpiece 14 of the mattress support 12. As the mattress support 12 is lowered in the manner described above, the cover 2 is allowed to fall forward. This action is shown in FIG. 8*b*. This process would be rather dangerous, however, if the cover 2 were allowed to fall without restrain. Therefore a gear assembly is provided to slow the fall of the cover 2 and is shown in FIG. 11.

Figure 11:
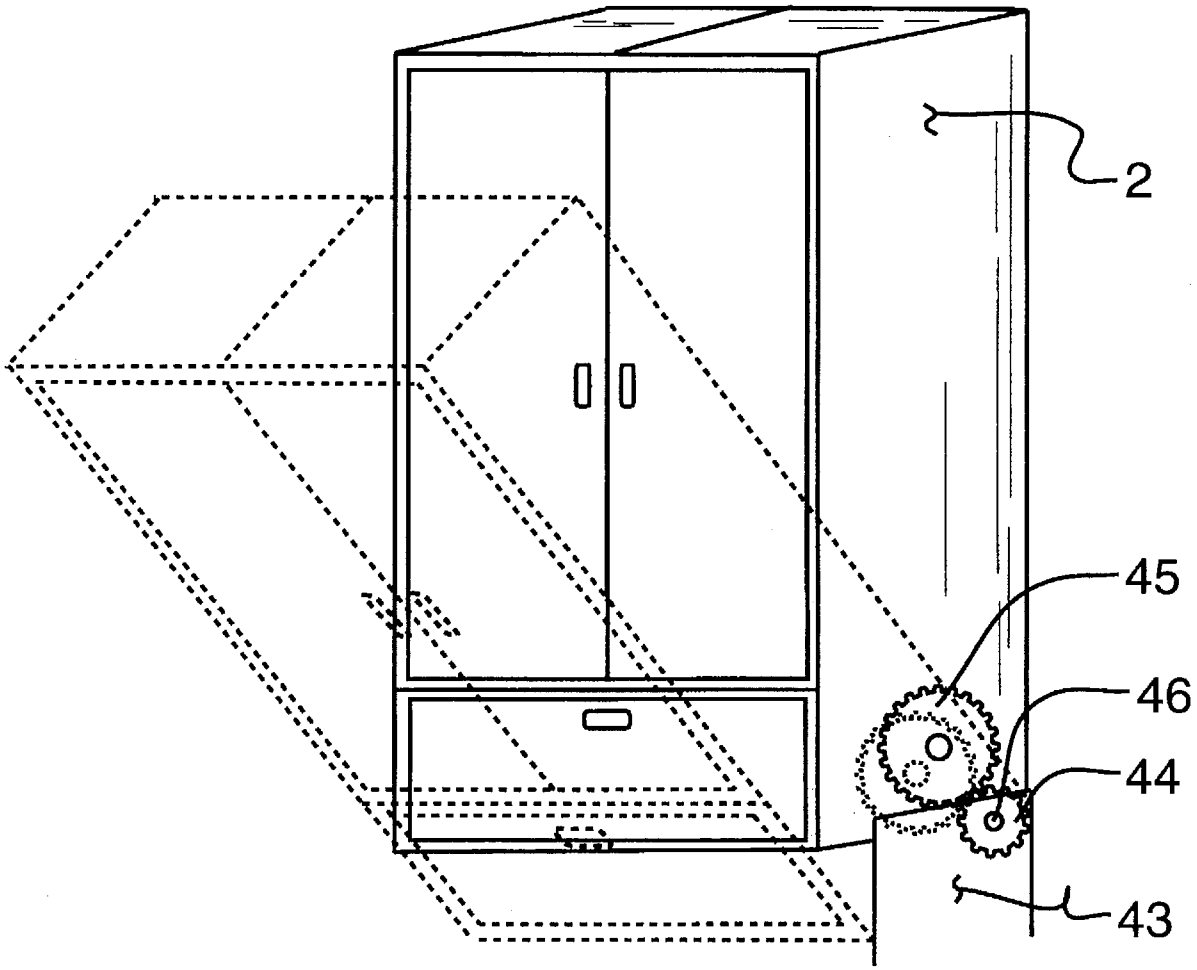
FIG. 11 is a perspective view of the upper cover portion of the present invention showing its downward movement.

Referring now to FIG. 11, the cover 2 is shown in both its upright and falling positions. The cover 2 is attached on either side to an outer support 43 by means of an axle 46. Each outer support 43 is further connected to the bed frame 5. One end of the axle 46 is attached to the inner wall of the outer support 43 while the other end of the axle 46 extends slightly into the inside of the cover 2. The portion of the axle 46 which is inside the cover 2 is surrounded by a small gear 44 which rotates around the axle 46. A larger gear 45 is also attached to the inside of the cover 2. The teeth of the larger gear 45 are aligned with the teeth of the smaller gear 44 such that the larger gear 45 rotates at a slower rate than the smaller gear 44, thereby slowing the fall of the cover 2 after the mattress support 12 has been released.

Referring again to FIG. 8*b*, the mattress support 12 will be well within the bed frame before the cover 2 is fully closed. When both the mattress support 12 and the cover 2 have been fully lowered, the occupant lying on the mattress support will be fully protected from any debris which falls onto the bed during an earthquake. As the debris accumulates, the extra weight will be absorbed by the compressible legs 16.

I claim:

1. An earthquake protective bed of approximately the same size as a conventional bed, generally comprising a head-end and a foot-end, more particularly comprising:

a. a lower rectangular frame comprising two long sides, a head-end short side, and a foot-end short side;

b. six legs extending upward from said rectangular frame, four of said legs extending upward from each corner of said lower rectangular frame, two of said legs extending upward from the middle of said long sides of said lower rectangular frame;

c. an upper rectangular frame of the same dimensions as said lower rectangular frame, comprising two long sides, a head-end short side, a foot-end short side having a top and bottom side, and being supported by said six legs;

d. two mattress support ledges extending inwardly from said foot-end short side of said upper rectangular frame;

e. a corner piece at each corner of said upper rectangular frame connecting said long sides to said short sides;

f. a mattress support having a head-end and a foot-end and resting on the top of said upper rectangular frame;

g. a triggering system installed within said head-end of said earthquake protective bed;

h. a mechanical mattress support lowering system installed below said head-end of said mattress support;

i. a leg-release system installed below said foot-end of said mattress support;

j. an outer support attached to either side of said head-end of said upper rectangular frame;

k. an alarm box;

l. an upper cover portion.

2. A leg for an earthquake protective bed as in claim 1 comprising:

a. a lower female portion;

b. an opening in the top of said female portion;

c. a spring housed within said female portion;

d. a male portion partially inserted into said opening in the top of said female portion, further resting on said spring.

3. A corner piece for an earthquake protective bed as in claim 1 comprising:

a. an "L" shaped body comprising two perpendicular ends;

b. two perpendicular horizontal prongs extending from each of said perpendicular ends of said "L" shaped body;

c. a vertical prong extending downward from the center of the bottom of said "L" shaped body.

4. A triggering system for an earthquake protective bed as in claim 2 comprising:

a. a narrow ledge extending inwardly from a leg of said head-end of said earthquake protective bed;

b. a weight resting on said narrow ledge;

c. a vertical lever attached to a vertical lever pivot and having a top end and a bottom end;

d. three rope pivots;

e. a rope having two ends and being attached at one end to said weight, looped around said three rope pivots, and attached at the other end to said bottom end of said vertical lever;

f. a pivoting trigger piece extending downward from a larger support beam and outwardly applying pressure to said top end of said vertical lever;

g. a ball bearing protruding from the side of said top end of said vertical lever which contacts said pivoting trigger piece.

5. A mattress support for an earthquake protective bed as in claim 2 comprising:

a. a rectangular frame having two long sides, a head-end short side, and a foot-end short side;

b. two cross support beams connecting said long sides;

c. a raised, trapezoidal piece extending upward from said head-end short side of said rectangular frame;

d. two small flywheels, one small flywheel extending from either side of said raised, trapezoidal piece;

e. a large gear extending from either side of said raised, trapezoidal piece and positioned at a proximal distance to said small flywheel.

6. A mechanical mattress support lowering system for an earthquake protective bed as in claim 5 comprising:

a. a vertical post having a wedge-shaped top and extending upward from either of said long sides of said lower rectangular frame at a location directly below either of said two small flywheels;

b. a vertical gear rail located at a distance from said vertical post such that the space created between said vertical gear rail and said vertical post is just large enough to accommodate said small flywheel and said large gear therebetween.

7. A leg release system for an earthquake protective bed as in claim 1 comprising two vertical supports, each of said vertical supports comprising:

a. a vertical post extending upward from said foot-end short side of said lower rectangular frame;

b. an upper pivot piece having an upper edge, lower inner edge, lower outer edge, and being initially positioned parallel to said vertical post so that said upper edge fully contacts and supports said bottom side of said foot-end short side of said upper rectangular frame;

c. a lower pivot piece having an upper inner edge, upper outer edge, lower inner edge, lower outer edge, and being positioned at an angle such that said upper inner edge contacts and rests against said lower outer edge of said upper pivot piece and said lower inner edge is positioned below said mattress support.

8. An alarm box for an earthquake protective bed as in claim 1 which is accessible from the inside of said earthquake protective bed and contains:

a. a conventional alarm;

b. a button for activating said conventional alarm;

c. non-perishable food;

d. stored water;

e. a first-aid kit.

9. An upper cover portion for an earthquake protective bed as in claim 1 comprising:

a. a rectangular storage space connected to said earthquake protective bed by means of a gear assembly attached to said outer supports;

b. said rectangular storage space containing a skeletal structure comprised of narrow, flexible, steel beams forming a reinforced rear wall, and four reinforced side walls;

c. said reinforced rear wall comprising an outer rectangular frame, a vertical cross beam, and two horizontal cross beams, said cross beams dividing said outer rectangular frame into six squares of equal size, each of said squares being further divided by two diagonal cross beams;

d. two of said four side walls each comprising three squares of equal size, each of said squares being divided by one diagonal cross beam;

e. two of said four side walls each comprising two squares of equal size, each of said squares being divided by one diagonal cross beam;

f. said rectangular storage space being connected to said lower bed portion by means of a gear assembly attached to said outer supports.

* * * * *